US005435540A

United States Patent [19]

Martin et al.

[11] Patent Number: 5,435,540

[45] Date of Patent: Jul. 25, 1995

[54] APPARATUS AND METHOD FOR SHEET FEEDING AND SEPARATING USING RETARD ROLL RELIEF/ENHANCEMENT

[75] Inventors: Michael J. Martin; Kathleen M. Martin, both of Hamlin; Russel J. Sokac, Rochester; Lloyd W. Durfey, Palmyra; Gerald M. Garavuso, Rochester; Robert P. Siegel, Penfield; Steven R. Moore, Rochester, all of N.Y.

[73] Assignee: Xerox Corporation, Stamford, Conn.

[21] Appl. No.: 205,447

[22] Filed: Mar. 4, 1994

Related U.S. Application Data

[63] Continuation-in-part of Ser. No. 983,933, Dec. 1, 1992, abandoned.

[51] Int. Cl.[6] ..... B65H 3/52

[52] U.S. Cl. ..... 271/122; 271/125; 271/259; 271/263; 271/265.04; 271/274

[58] Field of Search ..... 271/121, 122, 124, 125, 271/273, 274, 258, 259, 262, 263, 265

[56] References Cited

U.S. PATENT DOCUMENTS

| | | | |
|---|---|---|---|
| 4,561,644 | 12/1985 | Clausing . | |
| 4,978,111 | 12/1990 | Kosugi et al. . | |
| 5,104,109 | 4/1992 | Kubo . | |
| 5,172,900 | 12/1992 | Uno et al. | 271/125 |

FOREIGN PATENT DOCUMENTS

| | | | |
|---|---|---|---|
| 252839 | 10/1988 | Japan | 271/273 |
| 81727 | 3/1989 | Japan | 271/262 |
| 138035 | 5/1990 | Japan | 271/165 |
| 182637 | 7/1990 | Japan | 271/265 |
| 51248 | 3/1991 | Japan | 271/121 |
| 102053 | 4/1991 | Japan | 271/265 |
| 197931 | 7/1992 | Japan | 271/121 |
| 32356 | 2/1993 | Japan | 271/121 |
| 186082 | 7/1993 | Japan | 271/122 |

*Primary Examiner*—H. Grant Skaggs
*Assistant Examiner*—Carol L. Druzbick
*Attorney, Agent, or Firm*—Kenyon & Kenyon

[57] ABSTRACT

A sheet feeding and separating apparatus for feeding sheets from a stack by exerting a drive force against the top sheet. The sheet is urged off the stack by a nudger roll toward a retard nip formed where a feed roll contacts a retard roll. The retard roll is movable relative to the feed roll, and thus is capable of producing drive forces of varying magnitude at the retard nip to propel a sheet toward the copying mechanism. A controller signals the nudger roll to urge a sheet off the stack and then monitors a sensor to determine whether the sheet passes through the retard nip. A misfeed condition occurs when the sensor fails to detect a sheet within a predetermined length of time. In response, the controller moves the retard roll toward the feed roll to increase the drive force exerted on the sheet. The retard roll is further adapted to detect the occurrence of a multifeed when multiple sheets contact the retard nip. In response, the controller moves the retard roll away from, but remaining in contact with, the feed roll to decrease the drive force exerted on the sheet, thereby permitting individual sheets to pass through freely.

18 Claims, 6 Drawing Sheets

APPARATUS AND METHOD FOR SHEET FEEDING AND SEPARATING USING RETARD ROLL RELIEF/ENHANCEMENT

This application is a continuation-in-part of application Ser. No. 07/983,933, filed on Dec. 1, 1992, now abandoned.

BACKGROUND OF THE INVENTION

The present invention is directed to a method and apparatus for feeding sheets in a photocopying machine. More specifically, the present invention is directed to a sheet feeder system that uses a microprocessor controller to monitor the operation of a sheet feeder apparatus, checking for abnormal operating conditions such as misfeeds and multifeeds. When such conditions occur, the microprocessor controller causes adjustment of the retard nip normal force on the sheet to be fed, taking into consideration characteristics of the sheet, to correct the condition without operator intervention.

In a typical photocopying machine, sheets are contained in a sheet tray and are fed one-by-one into the photocopying apparatus. An individual sheet is taken from the top of a stack by a feed roll that engages the top surface of the sheet and rotates to strip the sheet away from the stack and into a sheet path. Such sheet feeder systems often include a sensor capable of detecting the presence of a sheet, positioned in the sheet path downstream from the feed roll and coupled to a microprocessor controller for the photocopying machine. Such sensors may be used to detect misfeeds in the following manner. The microprocessor controller, after signaling the feed roll to feed a sheet, measures the length of time between this signal and a return signal issued by the misfeed sensor upon detecting a sheet. If the time measured exceeds a predetermined maximum, the microprocessor controller recognizes a misfeed condition. In a typical photocopying machine, the microprocessor controller then signals the operator that a sheet has been misled and discontinues operation until the operator manually clears the misled sheet.

Misfeeds can occur in a photocopying machine of this type for various reasons including edge welds, static friction peaks and friction degradation in the feed components. A related problem associated with the operation of a typical sheet feeder system is multifeed, where multiple sheets are simultaneously fed through the sheet path instead of a single sheet. Thus, a primary goal in designing sheet feeder systems is to improve the system's ability to handle a variety of sheet types without misfeeds or multifeeds.

U.S. Pat. No. 4,561,644 to Clausing, the disclosure of which is incorporated in its entirety herein by reference, describes a sheet feeding and separating apparatus wherein the normal force applied to a stack of sheets by a feed mechanism is adjusted to reduce misfeeds and multifeeds. The apparatus includes a sensor similar to the misfeed sensor described above. If the sensor fails to detect a sheet within a predetermined time, the normal force exerted against the sheet stack is increased to correct the misfeed condition. The sheet feeding and separating apparatus is mounted on a frame that pivots about an axis. Upon detection of the sheet by the sensor, a solenoid is actuated to cause the frame to pivot, thereby decreasing the normal force against the stack to avoid multifeeds.

While the prior art discloses sheet feeder systems that attempt to reduce the amount of operator intervention required to correct abnormal feed conditions, such systems generally function in a trial-and-error manner in that they are not sensitive to characteristics of the sheets being fed or to recurring problems. There is a need for an "intelligent" photocopying machine capable of establishing an initial setup based on the type of sheet to be fed, actively monitoring operation of the sheet feeder system, making incremental adjustments in response to abnormal feed conditions, and modifying the initial setup to correct recurring problems. This and other needs are satisfied by the sheet feeder apparatus and method of the present invention.

SUMMARY OF THE INVENTION

The present invention is designed to reduce misfeeding and multifeeding in a photocopying machine through incremental and successive adjustment of the retard nip normal force applied to sheets fed from a stack into a sheet path. The retard nip normal force is increased whenever the sheet feeder system detects a misfeed or near misfeed condition and decreased whenever the system detects a multifeed or near multifeed condition. An optimal magnitude of the retard nip normal force to be applied for a particular sheet can be determined by a microprocessor controller using a look-up table of optimal normal force values for various types of sheets, with the type of sheet being fed either determined by a sensor or from information input to the system by an operator. These optimal retard nip normal forces are achieved by varying the physical position of a retard roll in the sheet feeder apparatus with respect to a feeder mechanism, either raising or lowering the retard roll by means of a solenoid, stepper motor or similar device.

The present invention also permits establishment of an initial setup for the photocopying machine based on characteristics of the sheets to be fed, and modification of this initial setup when the microprocessor controller detects that frequent adjustments are being made to the retard nip normal force. Thus, the sheet feeder system is able to compensate for friction degradation that may occur as rolls wear over the life of a machine without the need for manual operator intervention.

The present invention tends to decrease downtime for a photocopying machine by automatically correcting misfeed and multifeed conditions. Thus, the operator is not required to open the machine to clear the sheet path as often as would normally be required in a typical feed roll type of sheet feeder system. This result is desirable because it improves the efficiency of the copying process, thereby increasing the perceived reliability of the machine and making the machine more attractive to consumers. In effect, the operator views the photocopying machine as more "intelligent" than machines without this self-correcting capability.

DETAILED DESCRIPTION

Figure 1:
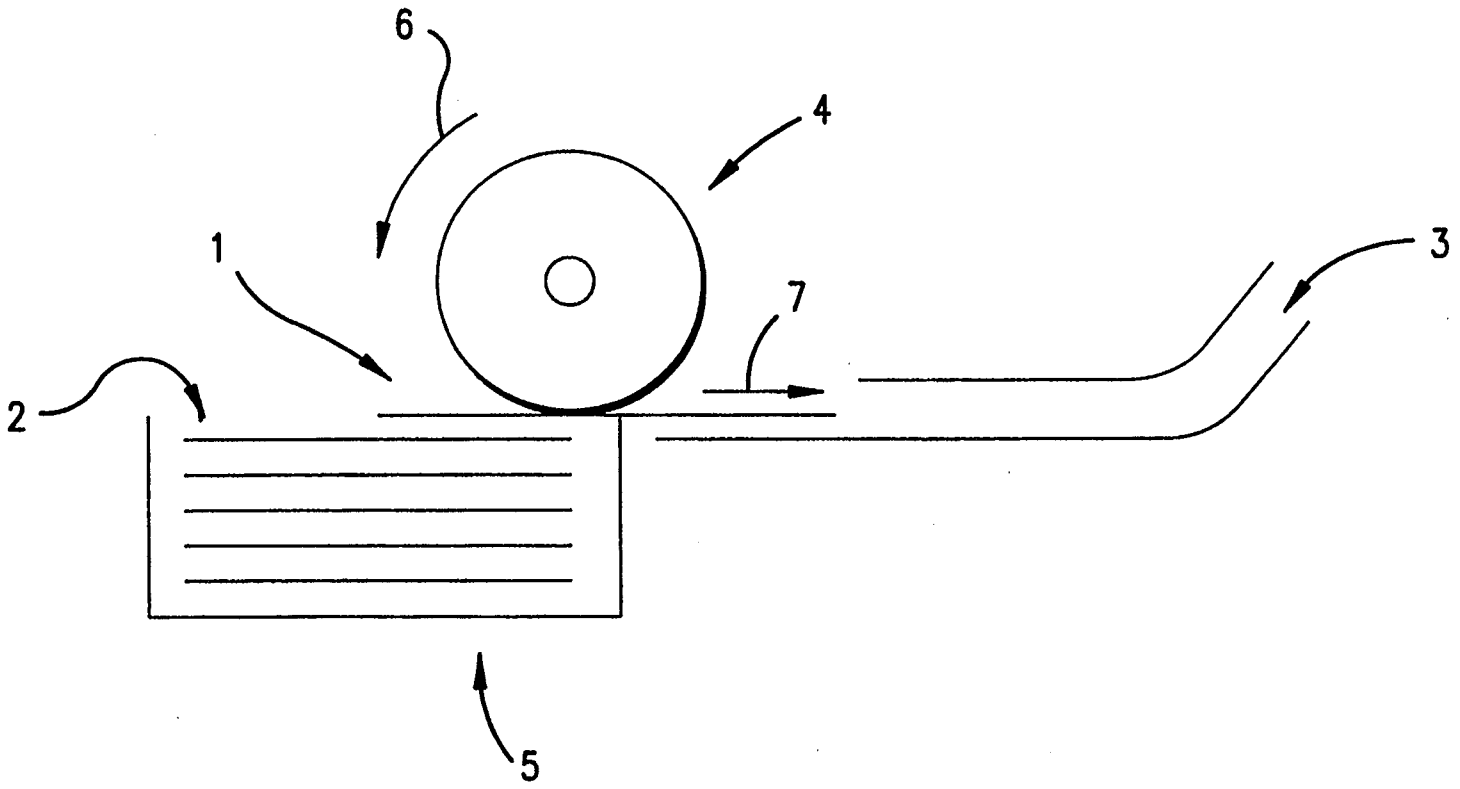
FIG. 1 PRIOR ART
FIG. 1 shows a conventional feed roll sheet feeder device known in the prior art.

FIG. 1 is a simplified schematic diagram of a feed roll type of sheet feeder device commonly used in photocopying machines to move a sheet 1 from a sheet stack 2 into a sheet path 3. In this device, a friction roll 4 is mounted for rotation at a fixed location above the sheet stack tray 5. A motor (not shown) rotates the roll 4 in the direction shown by reference numeral 6. Rotation of the roll 4 causes the outer surface of the roll 4 to advance the sheet 1 in the direction 7 into the sheet path 3. Because the roll 4 is mounted at a fixed location, the normal force of the roll 4 against the top sheet 1, and thus the frictional force pushing against the sheet 1 when the roll 4 rotates, is essentially constant. The device depicted in FIG. 1 cannot be adjusted to accommodate changes in sheet characteristics, friction degradation, or other factors that might affect the force necessary to feed the sheet 1 into the sheet path 3.

Figure 2:
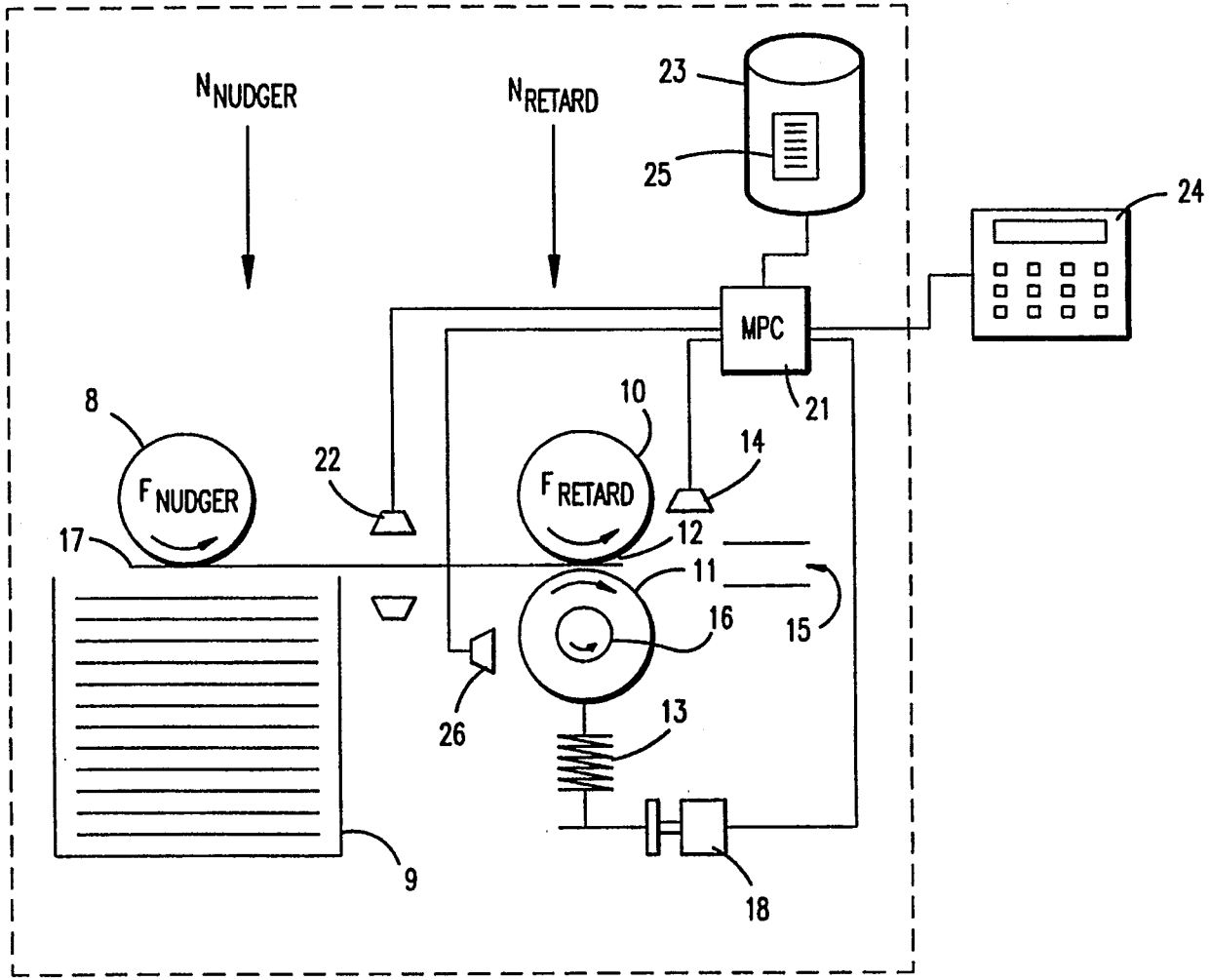
FIG. 2 shows an embodiment of a sheet feeder device according to the present invention.

FIG. 2 shows an embodiment of a sheet feeder device according to the present invention for use in a photocopying machine or similar device. A nudger roll 8 moves a sheet 17 off a sheet stack 9. A feed roll 10, moving at essentially the same speed as the nudger roll 8, drives the sheet 17 into the sheet path 15 of the photocopying machine. Alternatively, a feeder belt may be used to combine the nudger roll and feed roll functions. Such an arrangement is described in U.S. Pat. No. 4,561,644 to Clausing, incorporated herein by reference above. A retard roll 11 prevents additional sheets from being fed to the retard nip 12 located where the feed roll 10 contacts the retard roll 11. The retard roll 11 is coupled to a spring loading mechanism 13 with settings that may be altered using a solenoid or linear stepper motor 18, and is driven by means of a shaft coupled to a slip clutch 16. The slip clutch 16 may comprise a torsion spring device that exerts torque in a direction opposite the direction in which the feed roll 10 rotates, thus inhibiting like rotation by the retard roll 11. Additionally, an entrance guide (not shown) may be positioned between the nudger roll 8 and the feed roll 10 to perform a gating function, breaking up "slugs" of multiple sheets bonded together.

A microprocessor controller 21 controls the operation of the sheet feeder device of FIG. 2. The microprocessor controller 21 may comprise, for example, an 8085-type controller or any functionally similar device. Instructions may be hard-coded on the device, but more commonly the device will be an EPROM (Erasable Programmable Read Only Memory) device to more readily accommodate software upgrades. The microprocessor controller 21 may also be coupled to a memory 23 of the photocopying machine.

The sheet feeder device of FIG. 2 uses several sensors to provide information to the microprocessor controller 21 concerning the photocopying operation. For example, an opaqueness sensor 22 may be used to determine the thickness of the sheet 17 as it is being fed from the stack 9. Such a sensor is described in U.S. Pat. No. 5,138,178 to Wong et al. In addition, a misfeed sensor 14 may be used to detect the sheet 17 as it passes through the retard nip 12. Finally, the retard roll 11 may be coupled to a motion sensor 26 capable of signalling the microprocessor controller 21 whenever the retard roll 11 is rotating in the direction of the sheet stack 9, such as might occur during a multifeed condition.

The sheet feeder device also includes a user interface 24 coupled to the microprocessor controller 21. The user interface 24 would typically include data entry keys to permit an operator to control certain aspects of the copying operation, providing the microprocessor controller 21 with such information as the size of originals, the size and type of paper for copies, and the number of copies desired. In addition, the user interface 24 may include a display for providing information to the operator, such as job status and error conditions.

The retard roll 11 depicted in FIG. 2 is an active retard roll, though the present invention may also use a semi-active retard roll or a stationary retard roll. The active retard roll 11 is driven by a motor (not shown) in a direction opposite the direction of movement of the sheet 17, acting to push any additional sheets back toward the sheet stack 9. The active retard roll 11 rotates at approximately twice the speed of the feed roll 10 and nudger roll 8. A semi-active retard roll, rather than being rotated by a motor, is capable of being driven a small distance in the direction opposite the movement of the sheet by means of a torsion spring or some similar device. A stationary retard roll is incapable of rotation, and serves merely as a physical block for additional sheets.

Operation of the active retard roll 11 varies with the number of sheets passed to the retard nip 12. When no sheet is present at the retard nip 12, the torque exerted by the feed roll 10 on the retard roll 11 is sufficient to overcome the torque exerted by the slip clutch 16, driving the retard roll 11 in the same direction as the feed roll 10. Similarly, when only a single sheet 17 is present at the retard nip 12, as illustrated in FIG. 2, the torque exerted by the feed roll 10 on the retard roll 11 through the sheet 17 is still sufficient to overcome the torque of the slip clutch 16, again driving the retard roll 11 in the same direction as the feed roll 10. However, when two or more sheets are present at the retard nip 12, the torque exerted by the feed roll 10 on the retard roll 11 is no longer sufficient to overcome the torque of the slip clutch 16. Thus, while the feed roll 10 drives the top sheet in a direction away from the sheet stack 9, the retard roll 11 rotates in the opposite direction, acting to drive additional sheets back toward the sheet stack 9.

Turning to the dynamic forces present in the sheet feeder system of FIG. 2, the drive force on a sheet driven off a stack of sheets by a roll device is given generally by:

$$F_{drive}=N\mu$$

where N is the normal force acting on the sheet, and $\mu$ is the roll coefficient of friction.

For heavier weight sheets (e.g. 110 lb. bond paper), a relatively large drive force is required to move the sheet 17 off the sheet stack 9; however, that same drive force may be unsuitable for lighter weight sheets (e.g. 13 lb. bond paper). Light weight paper, for example, has a relatively low inter-sheet frictional characteristic that requires relatively little force to separate individual sheets from a stack; in fact, using too great a drive force may result in damage to the sheets. Since it is difficult to change the roll coefficient of friction while a photocopying machine is in operation, the preceding equation implies that an alternate means for adjusting the drive force is to adjust the normal force acting on the sheet.

More specifically, the dynamic forces acting on a sheet 17 in the sheet feeder system according to the present invention are shown as $F_{nudger}$ and $F_{retard}$ in FIG. 2. These are the forces applied to the sheet 17 at the nudger roll 8 and the retard nip 12, respectively. The drive force acting on the sheet 17 at the nudger roll 8 of FIG. 2 is given by:

$$F_{nudger}=N_{nudger}\mu_{rs}$$

where $N_{nudger}$ is the normal force at the nudger roll and $\mu_{rs}$ is the roll-to-sheet coefficient of friction.

In order to urge the sheet 17 from the sheet stack 9 and into the retard nip 12, the drive force $F_{nudger}$ at the nudger roll 8 must be greater than the sum of the static friction between the sheet 17 and the second sheet on the sheet stack 9 and the drag forces on the sheet 17 as it moves off the sheet stack 9. These drag forces include electrostatic forces and other frictional forces acting on the sheet 17. Particularly, $$F_{nudger}>(N_{nudger}+W)\mu_{ss}+drag\ forces$$

where W is the weight of one sheet and $\mu_{ss}$ is the sheet-to-sheet coefficient of friction.

If too great a drive force $F_{nudger}$ is exerted at the nudger roll 8, however, more than one sheet will be pulled from the sheet stack 9 and a multifeed occurs. Thus, in addition to satisfying the preceding equation, the drive force $F_{nudger}$ must also be less than the static friction between the second and third sheets on the sheet stack 9. Particularly, $$(N_{nudger}+W)\mu_{s1s2}+drag\ forces<F_{nudger}<(N_{nudger}+2W)\ \mu_{s2s3}$$

where $\mu_{s1s2}$ is the coefficient of friction between the first and second sheets, and $\mu_{s2s3}$ is the coefficient of friction between the second and third sheets.

Taking into consideration the feed roll 10 and the retard roll 11, the drive force acting on the sheet 17 at the retard nip 12 with the nudger force $F_{nudger}$ still applied is given by:

$$F_{nudger}+F_{retard}=N_{nudger}\mu_{rs}+N_{retard}\mu_{rs}$$

where $F_{retard}$ is the drive force exerted by the feed roll/retard roll combination and $N_{retard}$ s the normal force exerted at the retard nip.

The total drive force must now be greater than the sum of the static friction between the sheet 17 and the second sheet on the sheet stack 9, the drag forces on the sheet 17 as it moves off the sheet stack 9, and the torque exerted by the slip clutch 16. Particularly, $$F_{nudger}+F_{retard}>(N_{nudger}+W)\mu_{ss}+SCT/R+drag\ forces$$

where SCT is the slip clutch torque and R is the radius of the retard roll.

When more than one sheet is pulled off the sheet stack 9 and into the retard nip 12, the drive force required to feed the top sheet into the sheet path 15 is greater than the sum of the static friction between the sheet 17 and the second sheet at the nudger roll 8, the kinetic friction between the sheet 17 and the second sheet at the feed roll 10, and the drag forces on the sheet 17. Particularly, $$F_{nudger}+F_{retard}>(N_{nudger}+W)\mu_{ss}+N_{retard}\mu_{ss}+drag\ forces$$

At the same time, the force required to prevent an "nth" additional sheet from passing through the retard nip 12 can be described as follows:

$$(N_{retard}+(n-1)W)\mu_{ssn\ n-1}+(N_{nudger}+(n-1)W)\mu_{ssn\ n-1}<SCT/R+(N_{nudger}+Nw)\mu_{ssn\ n+1}+drag\ forces$$

Positional adjustment of the retard roll 11 With respect to the feed roll 10 varies the normal force, $N_{retard}$, being applied at the retard nip 12, thereby altering the total drive force applied to the sheet. Varying the retard nip normal force to allow for correct feeding of different types of sheets (e.g. different paper weights) may be accomplished by raising or lowering the retard roll 11 using a spring loading mechanism 13 coupled both to the retard roll 11 and a solenoid or a linear stepper motor 18. Adjustments of the retard nip normal force will typically lie in the range of 0.2 to 4 pounds.

The sheet feeder system of the present invention is capable of recognizing the probability of a misfeed or multifeed and reactively adjusting the retard nip normal force to reduce the likelihood of such an abnormal feed condition actually occurring. Such a probability is exhibited, for example, by repeated "near misfeeds," where the machine is required to adjust the retard nip normal force for successive sheets in order to feed them into the sheet path. Once such a probability is recognized, the sheet feeder system can take preventive measures such as adjusting the initial setup for the type of sheet being fed.

In general, a sheet feeder system constructed and operated according to the present invention may detect and respond to abnormal operating conditions such as misfeeds or multifeeds in the following manner. Again referring to FIG. 2, in response to an operator's initiating operation of the machine, the microprocessor controller 21 determines an initial setting for the height of the retard roll 11. This initial setting may be determined, for example, according to information retrieved from a lookup table 25 stored in the memory 23 based on paper characteristics input by the operator. Alternatively, the microprocessor controller 21 could maintain default settings corresponding to the size of paper being used for copying, or could simply use whatever setting the previous copying operation ended with. After identifying the initial setting, the microprocessor controller 21 signals the stepper motor 18 to set the retard roll 11 to the appropriate height.

After establishing the initial setting for the retard roll 11, the microprocessor controller 21 signals the sheet feeder device to feed the sheet 17 off the sheet stack 9 toward the sheet path 15. As the sheet 17 leaves the sheet stack 9, the opaqueness sensor 22 may be used to dynamically determine the thickness of the sheet 17 and provide that information to the microprocessor controller 21. The microprocessor controller then monitors the misfeed sensor 14 located near the retard nip 12 to determine if the sheet 17 has been properly fed.

If the sheet 17 fails to reach the misfeed sensor 14 within a predetermined time period, the microprocessor controller 21 recognizes a near misfeed condition. The microprocessor controller 21 may then retrieve an optimal normal force increment for the type of sheet 17 being fed, based either on the previous determination of sheet characteristics or the dynamic input from the opaqueness sensor 22, and increases the normal force, $N_{retard}$, at the retard nip 12 by urging the retard roll 11 toward the feed roll 10 using the stepper motor 18. This displacement of the retard roll 11 must be small enough to avoid damaging the sheet 17. If the increased retard nip normal force is still insufficient to feed the sheet 17 through the retard nip 12, the microprocessor controller 21 may repeat the increment of the retard nip normal force. A more detailed description of this self-correction process is provided below with reference to FIGS. 3A, 3B, 4 and 5.

The retard nip normal force may also be adjusted to correct a multifeed condition, such as occurs when multiple sheets are simultaneously fed to the retard nip 12. A multifeed or near multifeed condition might occur, for example, where the force exerted at the retard nip is too great to permit a sheet 17 to pass freely through the retard nip 12. In such a case, the slip clutch 16 of the active retard roll 11 will urge subsequent sheets back toward the sheet stack 9. This backward motion of the retard roll 11 may be detected by the motion sensor 26, which may signal the microprocessor controller 21 accordingly. The microprocessor controller 21 may then initiate a procedure analogous to that just described to reduce the normal force exerted at the retard nip 12, thereby permitting sheets to pass through freely.

Figure 3A:
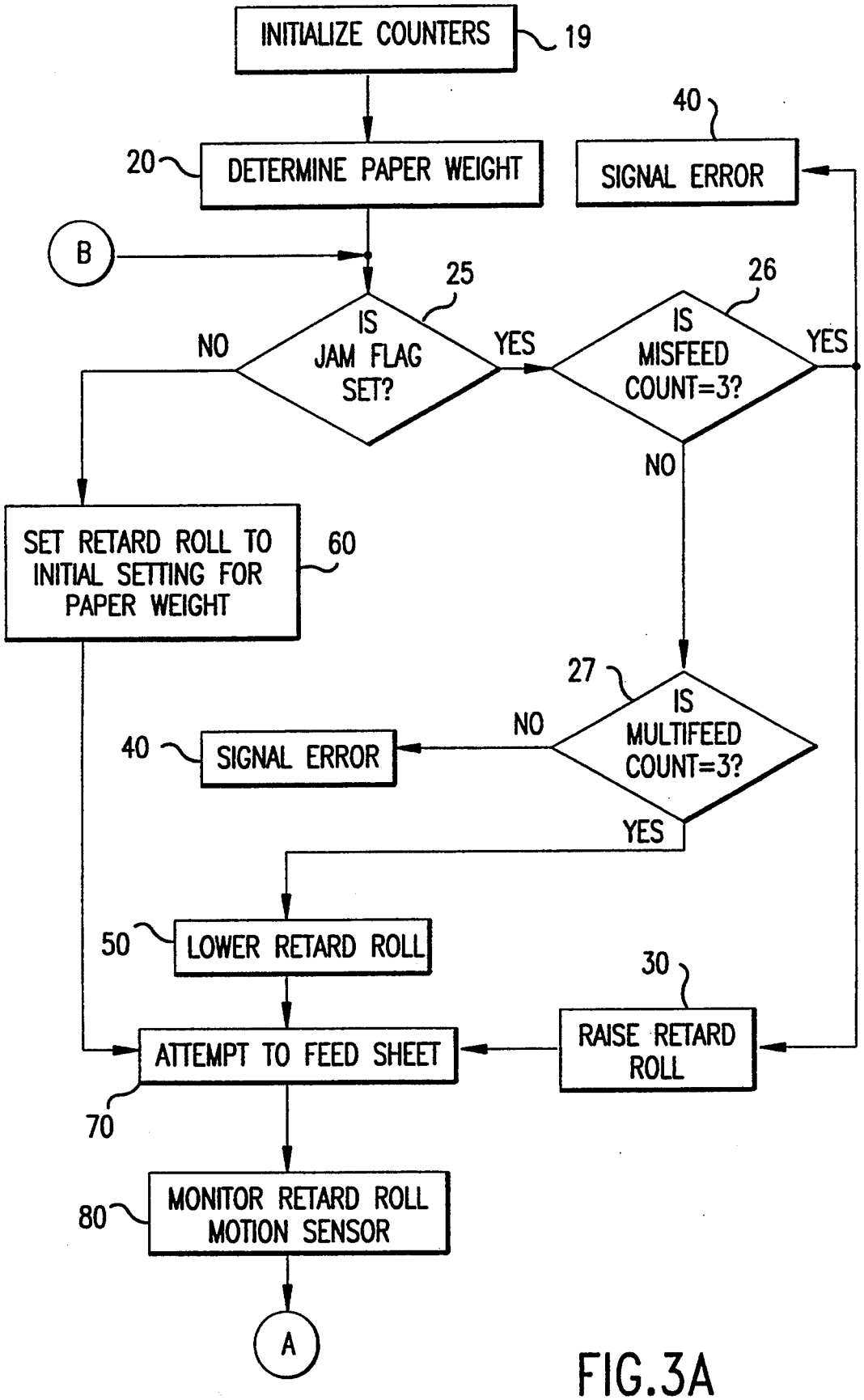
FIGS. 3A and 3B describe a method of operation for a sheet feeder system according to the present invention.
Figure 3B:
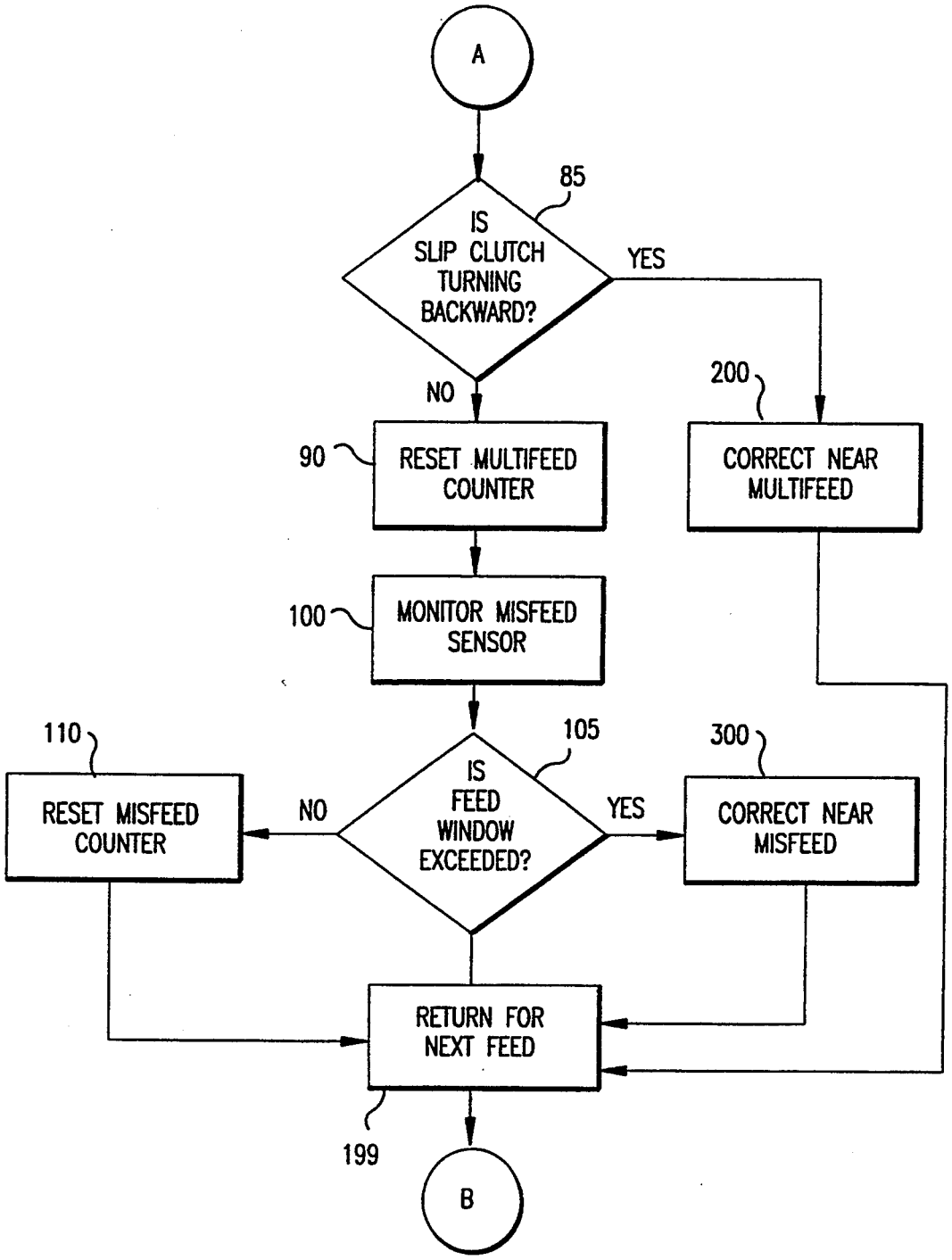

FIGS. 3A and 3B show a flow diagram illustrating the operation of a sheet feeder system according to the present invention. Processing begins when an operator initiates a photocopying session, for example, by pressing a "Copy" button. A controller for the photocopying machine sets a misfeed counter and a multifeed counter to zero, and sets a jam flag to "off" (19). Next, the weight of the sheet to be fed from the stack is determined and used to retrieve an initial retard roll height setting and optimal increment amount from a look-up table (20). Determining the sheet weight can be accomplished, for example, using operator input or a preset default value. The jam flag is then interrogated (25) to determine whether the last three attempted feeds resulted in either near misfeeds or near multifeeds, indicating that the initial settings for the sheet weight being fed should be adjusted.

If the jam flag is turned off, the controller sets the retard roll height to the initial setting retrieved for the sheet weight (60); otherwise, the controller determines whether the indicated jam condition was caused by successive near misfeeds (26) or successive near multifeeds (27). Recurring near misfeeds cause the controller to raise the retard roll by the optimal increment retrieved for the corresponding sheet weight (30); while recurring near multifeeds cause the controller to lower the retard roll by that same optimal increment (50). If neither a near misfeed nor a near multifeed is indicated, the controller signals an error condition and initiates system shutdown (40). Once the height of the retard roll is set, either to the initial setting or to an adjusted setting, the controller signals the sheet feeder apparatus to feed a sheet (70).

After the sheet feeder apparatus is signalled (70), the controller monitors a motion sensor coupled to the retard roll (80). If the motion sensor detects that a slip clutch coupled to the retard roll is turning backward (85), the controller initiates correction of a near multifeed condition in accordance with step 200 (see FIG. 4); otherwise, the controller resets the multifeed counter to zero (90) and monitors a misfeed sensor (100). If the misfeed sensor fails to detect a sheet within a predetermined period of time (105), the controller initiates correction of a near misfeed condition in accordance with step 300 (see FIG. 5). When the misfeed sensor detects a sheet, the controller resets the misfeed counter to zero (110). The above process is then repeated for the next sheet to be fed.

Figure 4:
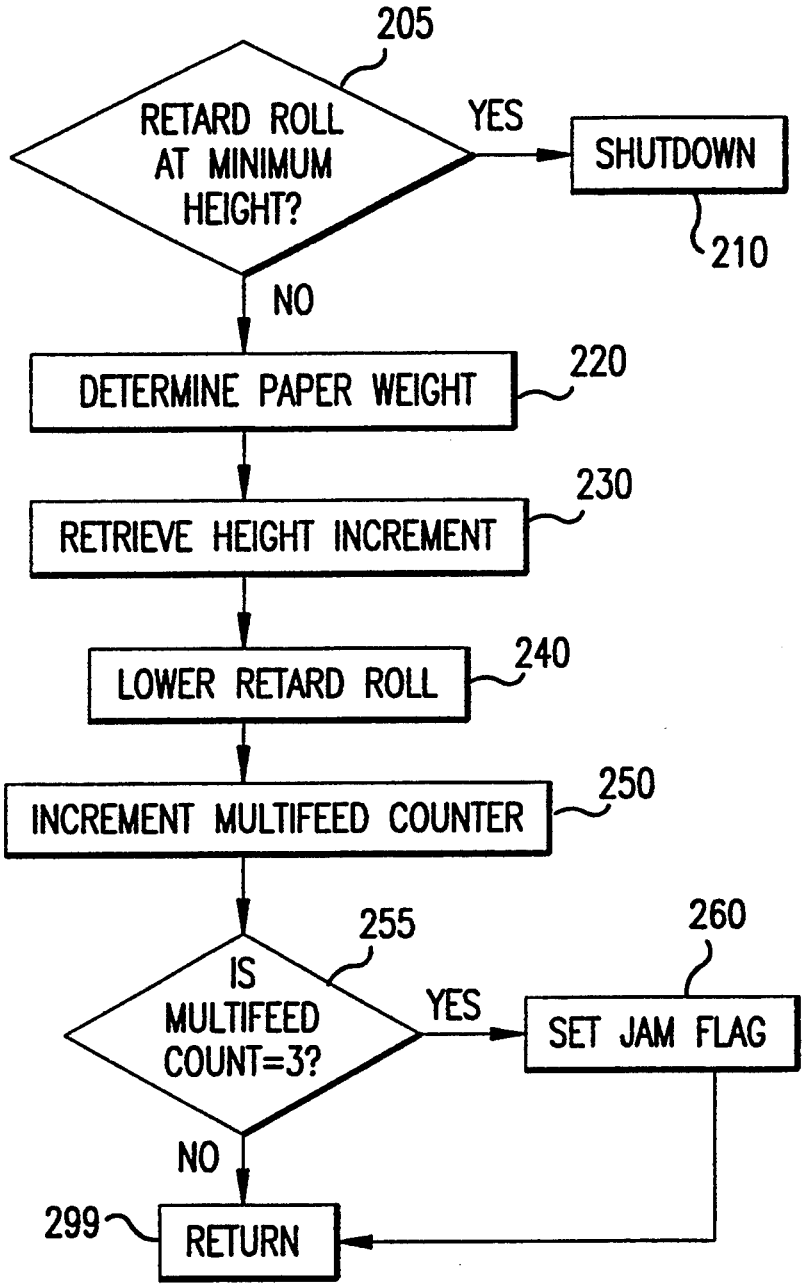
FIG. 4 describes a method of correcting near misfeeds according to the present invention.

FIG. 4 shows a flow diagram of the processing that may be used to correct a near multifeed condition according to the present invention. The controller first checks whether the retard roll is already at its minimum height (205). If so, the controller signals an error and initiates system shutdown (210); otherwise, the controller determines the sheet weight (220) for the paper being fed and lowers the retard roll by the retrieved optimal increment amount (230), (240), thereby decreasing the retard nip normal force on the sheet. Determination of the sheet weight (220) may be based on a preset default value, operator input, or an opaqueness sensor monitoring sheets as they are fed from the stack. After incrementing the multifeed counter (250), the controller checks whether the multifeed counter is equal to a predetermined maximum (255), setting the jam flag to "on" if the maximum has been reached (260). Processing then continues with the next sheet to be fed (299), as described above with reference to FIGS. 3A and 3B.

Figure 5:
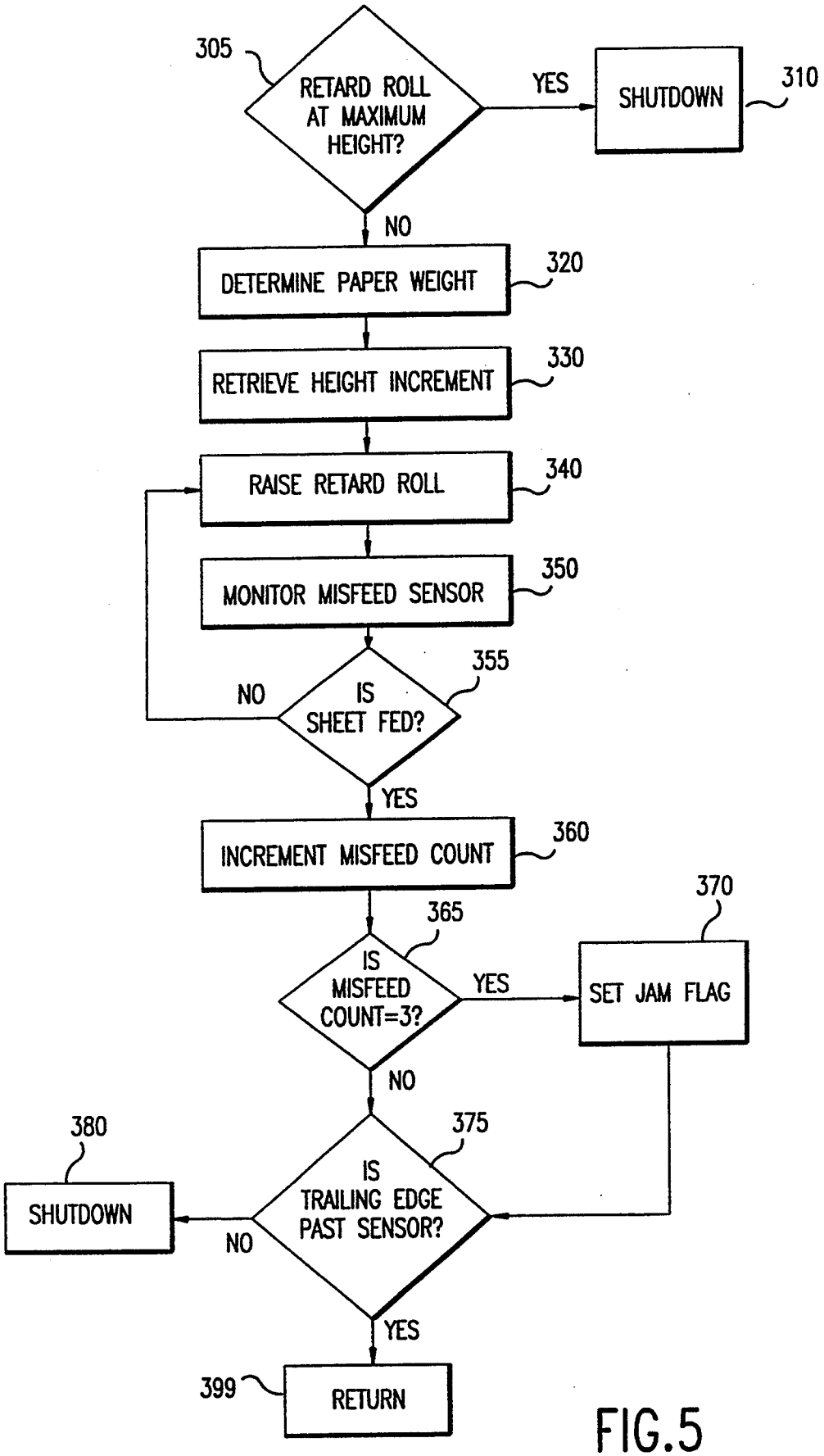
FIG. 5 describes a method of correcting near multifeeds according to the present invention.

FIG. 5 shows a flow diagram of the processing that may be used to correct a near misfeed condition according to the present invention. The controller first checks whether the retard roll is already at its maximum height (305). If so, the controller signals an error and initiates system shutdown (310); otherwise, the controller determines the sheet weight (320) by the method described above for step 220 and raises the retard roll by the retrieved optimal increment amount (330), (340), thereby increasing the retard nip normal force on the sheet. The controller then monitors the misfeed sensor (350) to determine whether the corrective action results in a sheet being fed. If a sheet is still not detected (355), the controller again increases the height of the retard roll. This process continues either until a sheet is successfully fed or until the retard roll reaches its maximum height. Once a sheet is fed, the controller increments the misfeed counter (360) and checks whether the counter is equal to a predetermined maximum value (365), setting the jam flag to "on" if the maximum has been reached (370). Next, the controller monitors the misfeed sensor to determine whether the trailing edge of the sheet being fed has passed the sensor (375). If it has, processing continues with the next sheet to be fed (399) as described above with reference to FIGS. 3A and 3B. If the trailing edge has not passed, meaning the sheet has become caught in the sheet feeder apparatus, the controller signals an error and initiates system shutdown (380).

Examples of photocopying machines to which the present invention is particularly suited include the Xerox Model 5046, Xerox Model 5028, and Xerox Model 5034. These examples are merely offered for illustration, since the present invention may be applied in many different types of photocopying machines.

While the present invention is described with reference to specific embodiments, it will be apparent to those skilled in the art that many modifications and variations are possible. Accordingly, the present invention embraces all alternatives, modifications and variations that fall within the spirit and scope of the appended claims, as well as all equivalents thereof.

What is claimed is:

1. A sheet feeding apparatus for transferring a sheet from a stack to a sheet path, comprising:

(a) a feeder means capable of exerting a selectively variable drive force against a sheet in a direction toward a sheet path;

(b) a normal force relief means coupled to said feeder means for changing the selectively variable drive force exerted by said feeder means;

(c) a data store associating a value of a selected characteristic of a sheet with a setting for said normal force relief means; and (d) a controller coupled to said normal force relief means and said data store, said controller adapted to determine a value for the selected characteristic of a sheet to be transferred, retrieve a corresponding setting for said normal force relief means from said data store, and manipulate said normal force relief means to said corresponding setting, wherein said controller recognizes a misfeed condition when a length of time between initiation of a sheet transfer operation and a transfer of a sheet by said feeder means exceeds a predetermined time period, said controller being adapted to correct the misfeed condition by manipulating said normal force relief means to increase the selectively variable drive force.

2. A sheet feeding apparatus for transferring a sheet from a stack to a sheet path, comprising:

(a) a feeder means capable of exerting a selectively variable drive force against a sheet in a direction toward a sheet path;

(b) a normal force relief means coupled to said feeder means for changing the selectively variable drive force exerted by said feeder means;

(c) a data store associating a value of a selected characteristic of a sheet with a setting for said normal force relief means; and (d) a controller coupled to said normal force relief means and said data store, said controller adapted to determine a value for the selected characteristic of a sheet to be transferred, retrieve a corresponding setting for said normal force relief means from said data store, and manipulate said normal force relief means to said corresponding setting, wherein said controller recognizes a multifeed condition when more than one sheet is present at said feeder means, said controller being adapted to correct the multifeed condition by manipulating said normal force relief means to decrease the selectively variable drive force.

3. The sheet feeding apparatus of claim 2 further comprising a user interface coupled to said controller for entry of a value for the selected characteristic of a sheet to be transferred.

4. The sheet feeding apparatus of claim 3 wherein said data store associates an increment for adjusting said normal force relief means with a value for the selected characteristic of a sheet.

5. The sheet feeding apparatus of claim 4 wherein said controller is capable of updating a setting for said normal force relief means maintained in said data store.

6. A sheet feeding apparatus for transferring a sheet in a photocopying device, comprising:

(a) a feeder means for urging a sheet toward a sheet path by exerting a drive force against the sheet;

(b) a retard means for preventing an additional sheet from being simultaneously driven toward the sheet path by said feeder means, said retard means in communication with said feeder means and acting with said feeder means to exert a combined drive force against the sheet;

(c) a normal force relief means coupled to said retard means for selectively altering the combined drive force;.

(d) a data store for associating a value for a selected characteristic of a sheet with an initial setting for said normal force relief means and an increment for selectively altering the combined drive force;.

(e) a controller coupled to said normal force relief means and said data store, said controller adapted to determine a value for said selected characteristic of a sheet to be transferred, retrieve a corresponding initial setting for said normal force relief means from said data store, and cause said normal force relief means to assume said corresponding initial setting;

(f) a misfeed sensor coupled to said controller and adapted to signal said controller when said feeder means transfers a sheet; and (g) a sensor coupled to said controller for evaluating said selected characteristic of a sheet to be transferred, said controller capable of altering the combined drive force in response to a signal from said sensor, wherein said controller recognizes a misfeed condition when a length of time between initiation of a sheet transfer operation and receipt of a signal from said misfeed sensor exceeds a predetermined time period, said controller adapted to correct said misfeed condition by increasing the combined drive force.

7. The sheet feeding apparatus of claim 6 wherein said controller recognizes a multifeed condition when more than one sheet is present at said retard means, said controller adapted to correct the multifeed condition by causing said normal force relief means to decrease the combined drive force.

8. The sheet feeding apparatus of claim 7 wherein said retard means comprises a roll mounted on a shaft equipped with a slip clutch, said roll adapted to rotate in a direction opposite that of said feeder means when more than one sheet is present between said feeder means and said retard means.

9. The sheet feeding apparatus of claim 8 further comprising a motion sensor coupled to said controller and adapted to signal said controller when said roll of said retard means rotates in a direction opposite that of said feeder means.

10. The sheet feeding apparatus of claim 8 wherein said retard means comprises a non-rotatable roll for preventing more than one sheet from passing between said feeder means and said retard means.

11. A sheet feeding apparatus for transferring successive sheets from a sheet stack to a sheet path in a photocopying device, comprising:

(a) a feeder means for urging sheets from the sheet stack in a direction toward the sheet path;

(b) a retard means for preventing multiple sheets from being simultaneously driven toward the sheet path by said feeder means, said retard means acting with said feeder means to exert a combined drive force against a sheet at a retard nip formed by a junction of said feeder means and said retard means;

(c) a normal force relief means coupled to said retard means for selectively altering said combined drive force;

(d) a means for establishing an initial combined drive force for feeding a first sheet toward the sheet path;

(e) a data store for associating a selected characteristic of a sheet with an increment for selectively altering said combined drive force;

(f) a misfeed sensor for detecting a sheet as it passes through said retard nip; and (g) a microprocessor controller capable of establishing said initial combined drive force prior to transferring a sheet and dynamically altering said combined drive force by an increment associated with said selected characteristic, wherein said controller recognizes a misfeed condition when a length of time between initiation of a sheet transfer operation and detection of a sheet by said misfeed sensor exceeds a predetermined time period, said controller adapted to correct the misfeed condition by causing said normal force relief means to increase said combined drive force.

12. The sheet feeding apparatus of claim 11 wherein said controller recognizes a multifeed condition when more than one sheet is present at said retard nip, said controller adapted to correct the multifeed condition by causing said normal force relief means to decrease said combined drive force.

13. The sheet feeding apparatus of claim 12 wherein said normal force relief means comprises a spring loading mechanism coupled to means for raising or lowering said spring loading mechanism.

14. The sheet feeding apparatus of claim 13 wherein said data store comprises a lookup table stored in a memory coupled to said microprocessor controller.

15. The sheet feeding apparatus of claim 14 wherein said selected characteristic of a sheet comprises sheet weight.

16. The sheet feeding apparatus of claim 11 further comprising a user interface for entry of an initial value for said selected characteristic of a sheet to be transferred.

17. A method of transferring sheets in a photocopying device, comprising the steps of:

(a) determining a value for a selected characteristic of a sheet to be transferred;

(b) setting an initial drive force of a sheet transfer means, said initial drive force corresponding to said value for said selected characteristic;

(c) initiating a sheet transfer operation;

(d) determining whether said sheet transfer means successfully transfers a sheet; and (f) adjusting said initial drive force by an amount corresponding to said selected characteristic if the sheet is not successfully transferred, wherein said adjustment comprises increasing said initial drive force if the sheet is not successfully transferred within a predetermined time period.

18. A method of transferring sheets in a photocopying device, comprising the steps of:

(a) determining a value for a selected characteristic of a sheet to be transferred;

(b) setting an initial drive force of a sheet transfer means, said initial drive force corresponding to said value for said selected characteristic;

(c) initiating a sheet transfer operation;

(d) determining whether said sheet transfer means successfully transfers a sheet; and (f) adjusting said initial drive force by an amount corresponding to said selected characteristic if the sheet is not successfully transferred, wherein said adjustment comprises decreasing said initial drive force if said sheet transfer means attempts to simultaneously transfer more than one sheet.

* * * * *

UNITED STATES PATENT AND TRADEMARK OFFICE

CERTIFICATE OF CORRECTION

PATENT NO. : 5,435,540

DATED : July 25, 1995

INVENTOR(S) : Michael J. MARTIN et al.

It is certified that error appears in the above-indentified patent and that said Letters Patent is hereby corrected as shown below:

| Column | Line | |
|---|---|---|
| 6 | 6 | Change "$N_{retard}+(n-1)W)\mu_{ssn\ n-1}+\ldots$" to --$N_{retard}+(n-1)W)\mu_{s_n s_{n-1}}+\ldots$--. |
| 6 | 7 | Change "$\mu_{ssn\ n-1}\ldots$" to --$\mu_{s_n s_{n-1}}\ldots$--; change "$\mu_{ssn\ n+1}\ldots$" to --$\mu_{s_n s_{n+1}}\ldots$--. |

Signed and Sealed this

Second Day of April, 1996

Bruce Lehman

*Attest:*

BRUCE LEHMAN

*Attesting Officer*

*Commissioner of Patents and Trademarks*